US011764015B2

(12) United States Patent
Nishida et al.

(10) Patent No.: US 11,764,015 B2
(45) Date of Patent: Sep. 19, 2023

(54) ELECTROMAGNETIC RELAY

(71) Applicant: OMRON Corporation, Kyoto (JP)

(72) Inventors: Takeshi Nishida, Kyoto (JP); Kazuki Furukawa, Kyoto (JP); Naoki Kawaguchi, Kyoto (JP); Takashi Tsukada, Kyoto (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/689,992

(22) Filed: Mar. 9, 2022

(65) Prior Publication Data

US 2022/0293373 A1 Sep. 15, 2022

(30) Foreign Application Priority Data

Mar. 15, 2021 (JP) ..... 2021-41695

(51) Int. Cl.
*H01H 50/04* (2006.01)
*H01H 50/14* (2006.01)
*H01H 50/56* (2006.01)

(52) U.S. Cl.
CPC ..... *H01H 50/04* (2013.01); *H01H 50/14* (2013.01); *H01H 50/56* (2013.01)

(58) Field of Classification Search
CPC ..... H01H 50/04
USPC ..... 335/128, 129, 78
See application file for complete search history.

(56) References Cited

U.S. PATENT DOCUMENTS 2,833,885 A * 5/1958 Wells ..... H01H 50/645 200/1 R
5,081,436 A * 1/1992 Nishi ..... H01H 50/14 335/131
5,122,770 A * 6/1992 Held ..... H01H 50/305 335/277
6,661,319 B2 * 12/2003 Schmelz ..... H01H 1/26 335/78
7,504,915 B2 * 3/2009 Takayama ..... H01H 50/642 335/131
8,159,321 B2 * 4/2012 Bollinger ..... H01H 50/546 335/106

FOREIGN PATENT DOCUMENTS

JP 2020-136101 A 8/2020

* cited by examiner

*Primary Examiner* — Alexander Talpalatski
(74) *Attorney, Agent, or Firm* — SHINJYU GLOBAL IP

(57) ABSTRACT

An electromagnetic relay includes a first fixed terminal, a second fixed terminal, a movable contact piece, a movable member, a contact spring, and an electromagnet block. The movable member is configured to move in a moving direction including a first direction and a second direction. The contact spring biases the movable contact piece in the first direction. The electromagnet block includes a movable iron piece and moves the movable member in the moving direction. The movable contact piece and the contact spring are disposed in the movable member by insertion from a side opposite to a side where the electromagnet block is located. The movable member includes a first member constituted by a single member. The first member includes a press portion to be pressed by the movable iron piece in accordance with rotation of the movable iron piece, and a support portion configured to support the movable contact piece.

16 Claims, 7 Drawing Sheets

ELECTROMAGNETIC RELAY

This application claims priority to Japanese Patent Application No. 2021-041695, filed Mar. 15, 2021. The contents of that application are incorporated by reference herein in their entirety.

FIELD

The present invention relates to an electromagnetic relay.

BACKGROUND

The electromagnetic relay disclosed in Japanese Unexamined Patent Application Publication No. 2020-136101 is configured with a fixed terminal, a movable contact piece, a movable member for holding the movable contact piece, an electromagnet block for moving the movable contact piece via the movable member, and a contact spring that is disposed in the movable member to bias the movable contact piece toward the fixed terminal.

The movable member is composed of two members, that is, a first member and a second member, in consideration of the ease of assembly of the movable contact piece and the contact spring. The movable contact piece and the contact spring are inserted into the first member from the side opposite the side where the electromagnet block is located, and are sandwiched from the moving direction of the movable member by the second member, which is coupled to the first member, and the first member. The second member prevents the contact spring from slipping out in the moving direction of the movable member.

SUMMARY

In the electromagnetic relay of Japanese Unexamined Patent Application Publication No. 2020-136101, since the movable member is composed of the two members, the movable contact piece is affected in the moving direction of the movable member by dimensional errors and assembly errors of the two members. As a result, the positional accuracy of the movable contact piece in the moving direction of the movable member may vary in the moving direction of the movable member.

An object of the present invention is, in an electromagnetic relay, to improve the positional accuracy of a movable contact piece in the moving direction of the movable member while improving the ease of assembly.

The electromagnetic relay according to one aspect of the present invention includes a first fixed terminal, a second fixed terminal, a movable contact piece, a movable member, and an electromagnet block. The first fixed terminal includes a first fixed contact. The second fixed terminal includes a second fixed contact. The movable contact piece includes a first movable contact facing the first fixed contact and a second movable contact facing the second fixed contact. The movable member supports the movable contact piece. The movable member is configured to move in a moving direction including a first direction from the first movable contact toward the first fixed contact and a second direction from the first fixed contact toward the first movable contact. A contact spring is disposed in the movable member and biases the movable contact piece in the first direction. The electromagnet block includes a movable iron piece and moves the movable member in the moving direction. The movable iron piece is rotatable. The movable contact piece and the contact spring are disposed in the movable member by insertion from a side opposite to a side where the electromagnet block is located. The movable member includes a first member constituted by a single member. The first member includes a press portion to be pressed in the first direction by the movable iron piece in accordance with the rotation of the movable iron piece, and a support portion configured to support the movable contact piece in the moving direction of the movable member.

In this electromagnetic relay, since the movable contact piece and the contact spring are inserted into the movable member from the side opposite the side on which the electromagnet block is located, an improvement in the ease of assemble can be achieved. Further, since the movable member moves in accordance with the rotation of the movable iron piece, the movable contact piece and the contact spring can be supported by the first member constituted by a single member in the moving direction of the movable member. With this configuration, it is possible to improve the position accuracy of the movable contact piece in the moving direction of the movable member. Moreover, the first member includes the press portion that is pressed by the movable iron piece and the support portion for supporting the movable contact piece in the moving direction of the movable member, and thereby it is possible to further improve the positional accuracy of the movable contact piece in the moving direction of the movable member, as compared to the case of the press portion and the support portion being constituted by separate members.

The contact spring may be disposed in contact with the first member of the movable member and the movable contact piece in the moving direction of the movable member. In this case, it is possible to achieve a further improvement in the position accuracy of the movable contact piece in the moving direction of the movable member.

The electromagnetic relay may further include a return spring that is disposed in contact with the first member of the movable member and that biases the first member of the movable member in the second direction. In an electromagnetic relay including such a return spring disposed in contact with the movable member, the positional accuracy of the movable contact piece in the moving direction of the movable member can be improved.

The electromagnetic relay may further include a base that is disposed in contact with only the first member with respect to the movable member and that guides the movement of the movable member. In this case, since the base contacts only the first member with respect to the movable member, the positional accuracy between the movable member and the base can be improved. As a result, tilting and wear of the movable member can be decreased.

The base may be configured to limit movement of the movable member in a longitudinal direction and a lateral direction of the movable contact piece. In this case, the positional accuracy between the movable member and the base can be improved in the longitudinal and lateral directions of the movable contact piece.

The movable member may further include a second member that is separate from the first member. The first member may have an insertion hole that opens toward the side opposite the side on which the electromagnet block is located and into which the movable contact piece and the contact spring are inserted. The second member may be assembled to the first member from the side opposite to the side on which the electromagnet block is located, so as to prevent the movable contact piece and the contact spring from slipping out of the insertion hole. In this case, the second member can prevent the movable contact piece and the contact spring from slipping out.

The second member may include a positioning portion configured to position the movable contact piece in the longitudinal direction of the movable contact piece. The movable contact piece may further include a first engaging portion engaging with the positioning portion of the second member. In this case, the movable contact piece can be positioned in the longitudinal direction of the movable contact piece.

The first member may include a positioning portion configured to position the movable contact piece in the longitudinal direction of the movable contact piece. The movable contact piece may further include a second engaging portion engaging with the positioning portion of the first member. In this case, the movable contact piece can be positioned in the longitudinal direction of the movable contact piece.

Movement of the movable contact piece in the lateral direction may be restricted by the first member and the second member of the movable member. In this case, the movable contact piece can be positioned in the longitudinal direction of the movable contact piece.

The movable contact piece may further include a spring support portion configured to position the contact spring. In this case, the contact spring can be positioned by the movable contact piece.

DETAILED DESCRIPTION

Hereinbelow, an embodiment of an electromagnetic relay according to one aspect of the present invention will be described with reference to the drawings. Note that in each drawing, the X1 direction will be described as the left direction, the X2 direction as the right direction, the Y1 direction as the front direction, the Y2 direction as the rear direction, the Z2 direction as the upward direction, and the Z1 direction as the downward direction. In the present embodiment, the Z1 direction is an example of the first direction, and the Z2 direction is an example of the second direction. It should be noted that these directions are defined for convenience of explanation, and do not limit the arrangement direction of the electromagnetic relay.

Figure 7:
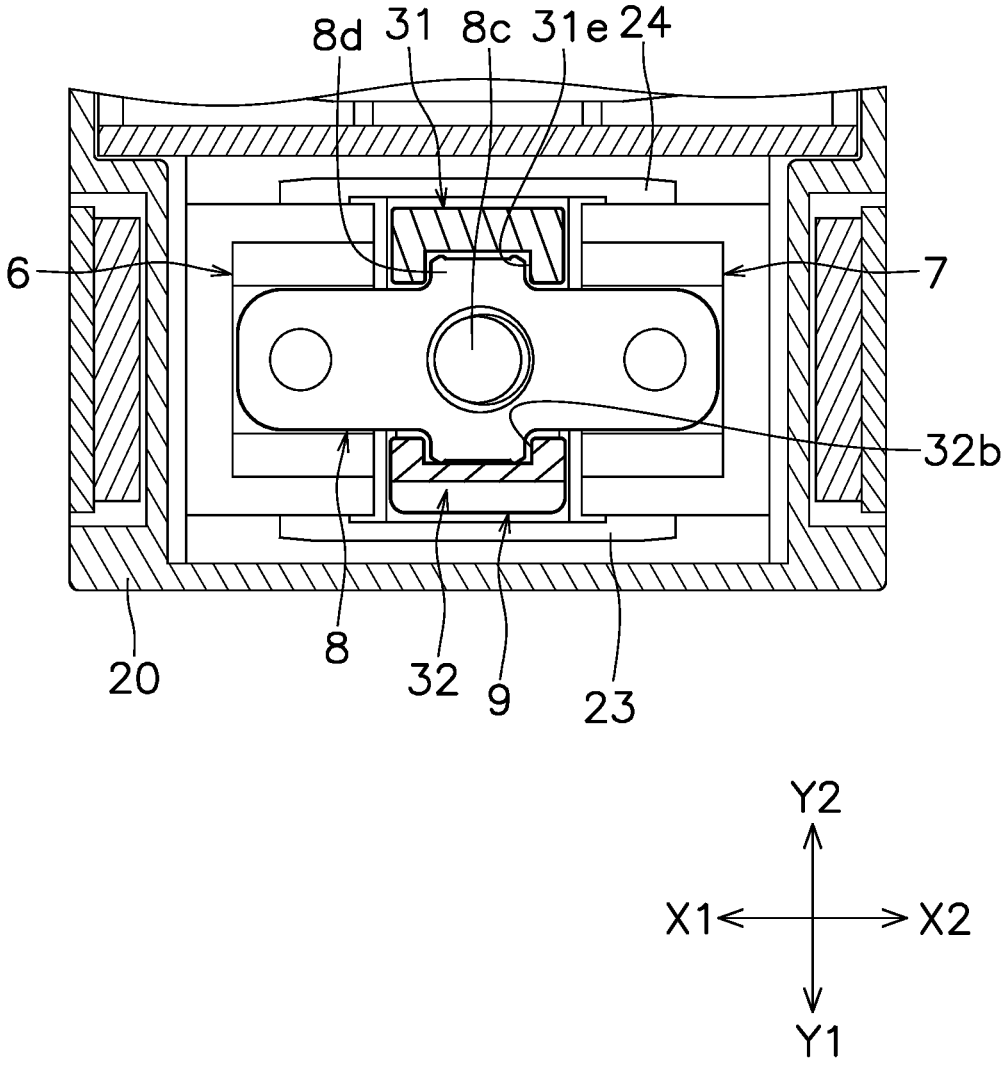
FIG. 7 is a partial cross-sectional view of the electromagnetic relay cut along a plane orthogonal to the up-down direction.

As shown in FIGS. 1 to 4, the electromagnetic relay 1 includes a base 2, a contact device 3, and an electromagnet block 4. The base 2 is made of an insulating material such as resin. The base 2 supports the contact device 3 and the electromagnet block 4. The contact device 3 and the electromagnet block 4 are covered by a case 20 (see FIG. 7) that is attached to the base 2. Note that, in FIGS. 1 to 4, illustration of the case 20 is omitted.

Figure 4:
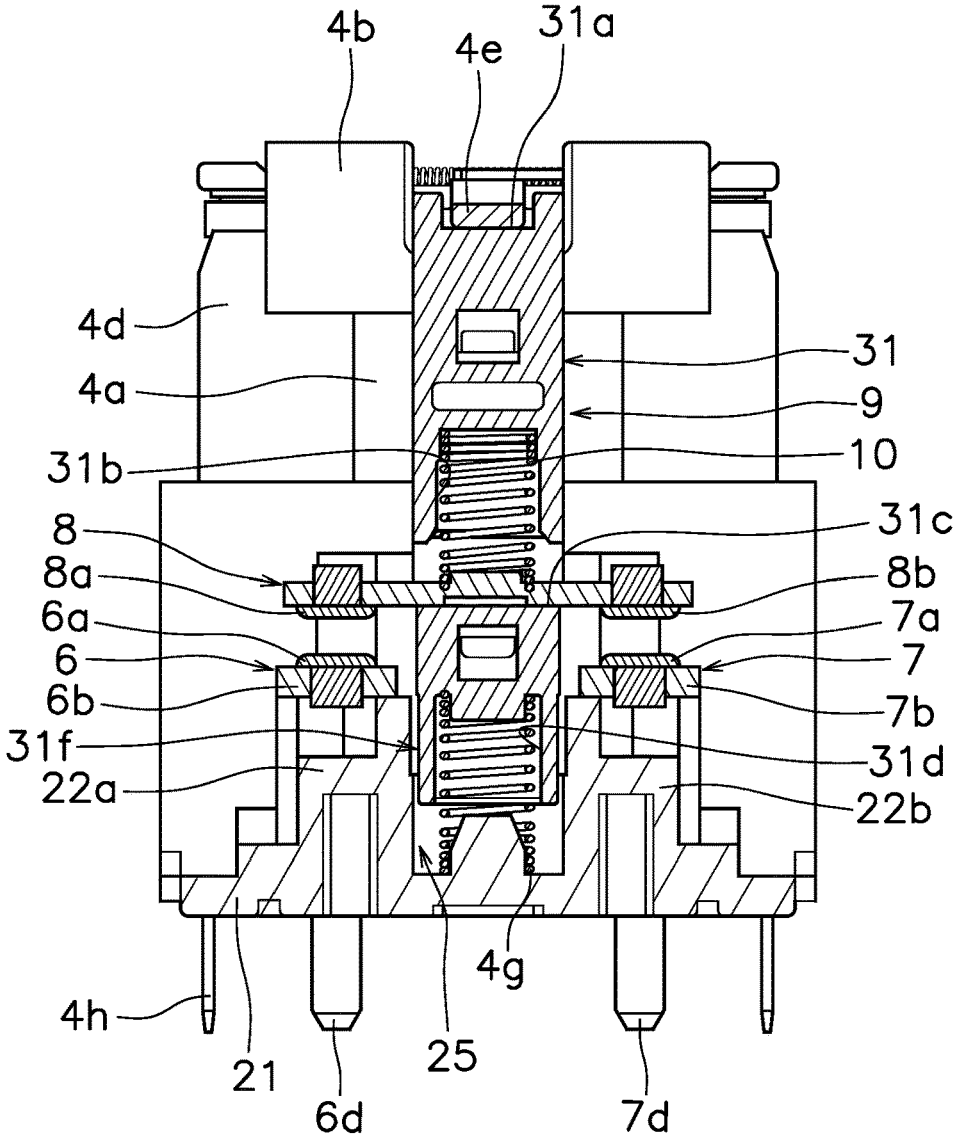
FIG. 4 is a cross-sectional view of a contact device cut along a plane orthogonal to the front-rear direction.
Figure 4:
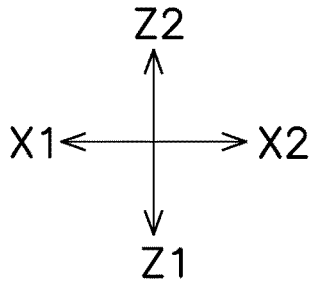
Figure 5:
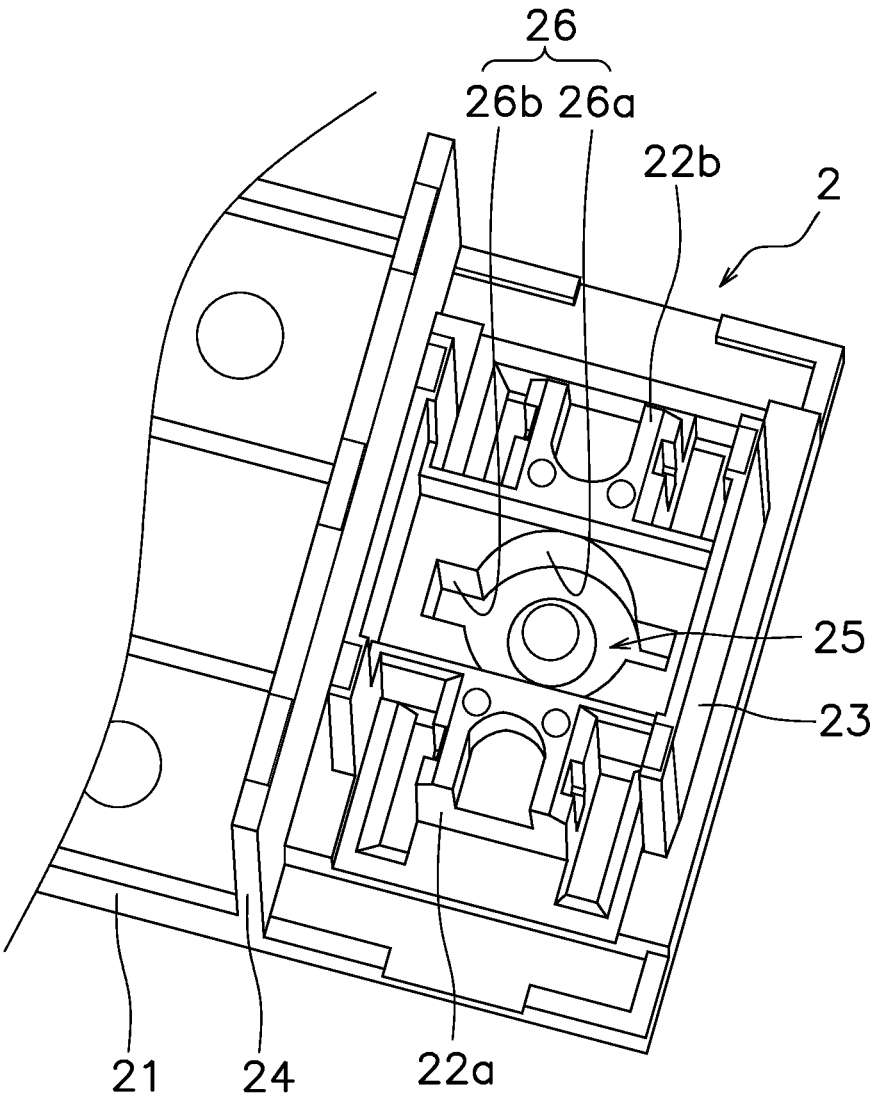
FIG. 5 is a perspective view of a base.
Figure 6:
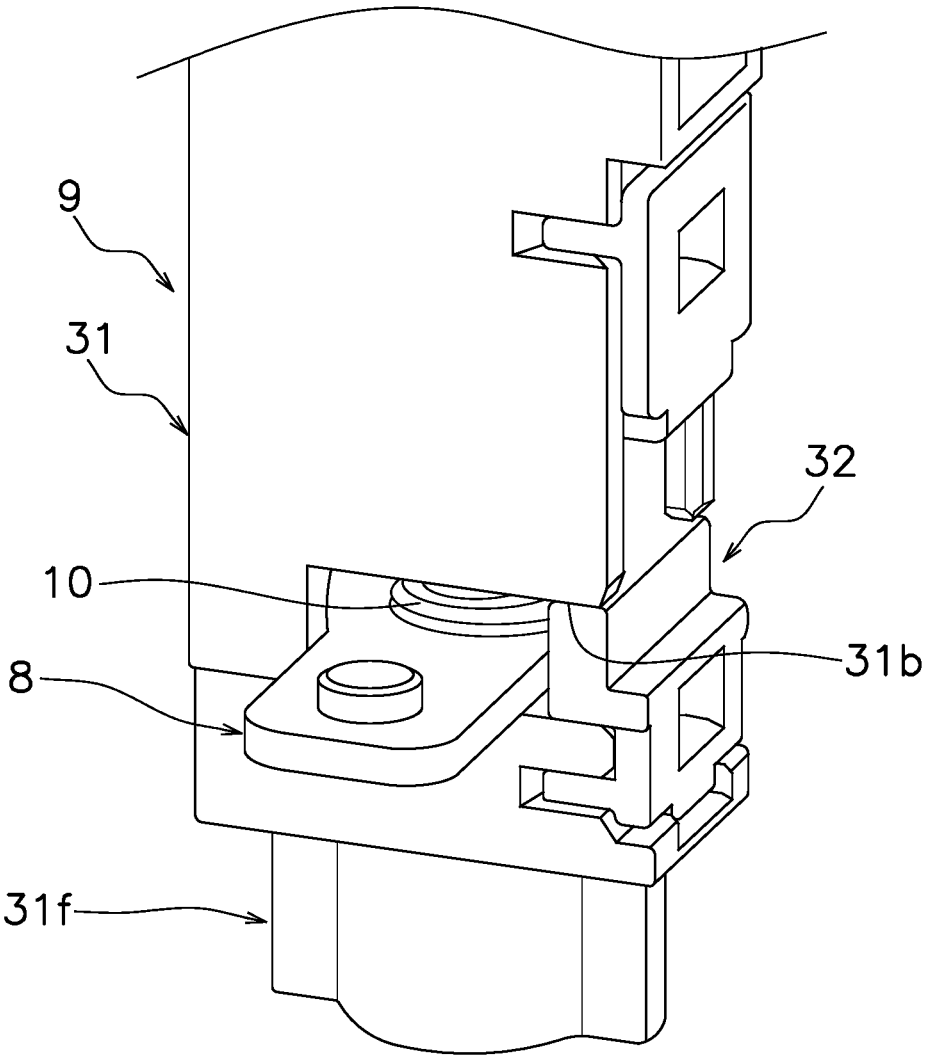
FIG. 6 is a partial perspective view of a movable member.

FIG. 4 is a cross-sectional view of the contact device 3 cut along a plane orthogonal to the front-rear direction. FIG. 5 is a partial perspective view of the base 2. The base 2 includes a bottom portion 21, terminal support portions 22*a* and 22*b*, a first wall portion 23, and a second wall portion 24. The bottom portion 21 has a rectangular shape when viewed from the up-down direction.

The terminal support portions 22*a* and 22*b* are formed so as to protrude upward from the bottom portion 21. The terminal support portion 22*a* is disposed apart from the terminal support portion 22*b* in the left-right direction. The upper surfaces of the terminal support portions 22*a* and 22*b* include flat surfaces orthogonal to each other in the up-down direction.

The first wall portion 23 extends in a direction orthogonal to the front-rear direction. The first wall portion 23 protrudes upward from the bottom portion 21 and extends in the left-right direction. The first wall portion 23 is disposed further forward than the terminal support portions 22*a* and 22*b*. The second wall portion 24 faces the first wall portion 23 in the front-rear direction. The second wall portion 24 is disposed behind the terminal support portions 22*a* and 22*b*.

The contact device 3 includes a first fixed terminal 6, a second fixed terminal 7, a movable contact piece 8, a movable member 9, and a contact spring 10. The first fixed terminal 6, the second fixed terminal 7, and the movable contact piece 8 are plate-shaped terminals and are made of a conductive material such as copper.

The first fixed terminal 6 and the second fixed terminal 7 each have a U-shaped cross section, and when viewed from the left-right direction have a shape bent in a U-shape. The first fixed terminal 6 and the second fixed terminal 7 are supported by the base 2. The first fixed terminal 6 and the second fixed terminal 7 are fixed by being press-fitted into the base 2, for example.

The first fixed terminal 6 includes a first fixed contact 6*a*, a contact support portion 6*b*, a pair of extending portions 6*c*, and a pair of external connection portions 6*d*. The first fixed contact 6*a* is disposed on the contact support portion 6*b*. The first fixed contact 6*a* is fixed by being caulked to the first fixed terminal 6.

The contact support portion 6*b* is supported by the upper surface of the terminal support portion 22*a*. The contact support portion 6*b* extends in a direction orthogonal to the up-down direction. The contact support portion 6*b* supports the first fixed contact 6*a*. The first fixed contact 6*a* is fixed by being caulked to the contact support portion 6*b*. The first fixed contact 6*a* may be welded to the first fixed terminal or may be integrated with the first fixed terminal 6.

The pair of extending portions 6*c* are fixed by being press-fitted into the bottom portion 21 of the base 2. The pair of extending portions 6*c* respectively extend at an angle downward from both ends in the front-rear direction of the contact support portion 6*b*, and protrude downward from the bottom portion 21 of the base 2. The pair of external connection portions 6*d* are respectively disposed at the lower ends of the pair of extending portions 6*c*, and are electrically connected to an external device (not shown).

The second fixed terminal 7 is disposed apart from the first fixed terminal 6 in the left-right direction. The second fixed terminal 7 has a shape similar to that of the first fixed terminal 6. The second fixed terminal 7 includes a second fixed contact 7*a*, a contact support portion 7*b*, a pair of extending portions 7*c*, and a pair of external connection portions 7*d*. Since each configuration of the second fixed terminal 7 is the same as each corresponding configuration of the first fixed terminal 6, descriptions thereof will be omitted.

The movable contact piece 8 extends in the left-right direction. The longitudinal direction of the movable contact piece 8 coincides with the left-right direction. The lateral direction of the movable contact piece 8 coincides with the front-rear direction. The movable contact piece 8 is disposed above the first fixed terminal 6 and the second fixed terminal 7. The movable contact piece 8 is inserted into the movable member 9 from the side opposite to the side where the electromagnet block 4 is located. That is, in the present embodiment, the movable contact piece 8 is inserted into the movable member 9 from the front side.

The movable contact piece 8 includes a first movable contact 8*a*, a second movable contact 8*b*, a spring support portion 8*c*, and a pair of engaging portions 8*d*. The first movable contact 8*a* and the second movable contact 8*b* are disposed on the lower surface of the movable contact piece 8. The first movable contact 8*a* faces the first fixed contact 6*a* in the up-down direction and is able to make contact with the first fixed contact 6*a*. The second movable contact 8*b* faces the second fixed contact 7*a* in the up-down direction and can make contact with the second fixed contact 7*a*. In the present embodiment, the first movable contact 8*a* and the second movable contact 8*b* are fixed by being caulked to the movable contact piece 8. The first movable contact 8*a* and the second movable contact 8*b* may be welded to the movable contact piece 8 or may be integrated with the movable contact piece 8.

The spring support portion 8*c* supports the contact spring 10. The spring support portion 8*c* is disposed at the center of the movable contact piece 8 in the longitudinal direction. The spring support portion 8*c* is a protrusion protruding upward from the upper surface of the movable contact piece 8.

The pair of engaging portions 8*d* are formed so as to protrude outward from both ends of the movable contact piece 8 in the lateral direction near the center of the movable contact piece 8 in the longitudinal direction. The pair of engaging portions 8*d* are an example of the first engaging portion and the second engaging portion.

The movable contact piece 8 is movable in a moving direction including a Z1 direction from the first movable contact 8*a* toward the first fixed contact 6*a* and a Z2 direction from the first fixed contact 6*a* toward the first movable contact 8*a*. In the present embodiment, the movable contact piece 8 is movable in the up-down direction. The movable contact piece 8 is supported by the movable member 9. The movable contact piece 8 penetrates the movable member 9 in the left-right direction. The movable contact piece 8 moves in response to the movement of the movable member 9. The movable contact piece 8 is relatively movable with respect to the movable member 9 in the up-down direction.

The movable member 9 is made of an insulating material such as resin. The movable member 9 supports the movable contact piece 8. The movable member 9 extends in the up-down direction. The movable member 9 is disposed at the center of the movable contact piece 8 in the left-right direction.

The movable member 9 is, at the upper end, coupled to the electromagnet block 4. The movable member 9 is movable in the moving direction including the Z1 direction and the Z2 direction. In the present embodiment, the movable member 9 is movable in the up-down direction.

Here, as shown in FIG. 5, the base 2 includes a recess 25 and a guide portion 26. The recess 25 is disposed between the first wall portion 23 and the second wall portion 24. The recess 25 is formed so as to be recessed downward from the upper surface of the bottom portion 21. The recess 25 opens upward. The recess 25 is formed in a non-circular shape when viewed from the up-down direction. The guide portion 26 guides the movement of the movable member 9 in the up-down direction. The guide portion 26 is constituted by a portion of the recess 25. The guide portion 26 is constituted by the inner surface of the recess 25. The guide portion 26 includes a circular portion 26*a* and a convex portion 26*b* that protrudes outward in the front-rear direction from the circular portion 26*a*.

The movable member 9 includes a first member 31 and a second member 32. The first member 31 is constituted by a single member. The outer diameter dimension of the first member 31 corresponds to the outer diameter dimension of the movable member 9. That is, the outer diameter dimension of the movable member 9 is the outer diameter dimension of the first member 31, which is constituted by a single member. In the present embodiment, in the left-right direction, the base 2 contacts only the first member 31 with respect to the movable member 9. In the front-rear direction, the base 2 contacts only the first member 31 with respect to the movable member 9. In the up-down direction, the base 2 contacts only the first member 31 with respect to the movable member 9. The base 2 limits the movement of the movable member 9 in the longitudinal direction and the lateral direction of the movable contact piece 8. Movement of the first member 31 in the left-right direction and the front-rear direction is restricted by the first wall portion 23, the second wall portion 24, and the guide portion 26.

The first member 31 includes a press portion 31*a*, an insertion hole 31*b*, a support portion 31*c*, a spring accommodating portion 31*d*, a positioning portion 31*e*, and a sliding portion 31*f*. The press portion 31*a* is disposed on the upper part of the first member 31. The upper surface of the press portion 31*a* is formed to be substantially flat. In accordance with the rotation of a movable iron piece 4*e* described below, the press portion 31*a* is pressed downward by the movable iron piece 4*e*.

The insertion hole 31*b* is a hole where the movable contact piece 8 and the contact spring 10 are inserted from the side opposite to the side where the electromagnet block 4 is located. The insertion hole 31*b* is open toward the front. The insertion hole 31*b* has a shape that is recessed from the front surface of the first member 31 toward the rear. The insertion hole 31*b* is open in the left-right direction.

The support portion 31*c* supports the movable contact piece 8 in the up-down direction. The support portion 31*c* is constituted by a part of the lower surface of the insertion hole 31*b*. The support portion 31*c* is constituted by a flat surface orthogonal to the up-down direction. The support portion 31*c* comes into contact with the lower surface of the movable contact piece 8.

The spring accommodating portion 31*d* is located inside the sliding portion 31*f* and is disposed at the bottom of the first member 31. The spring accommodating portion 31*d* opens downward. The spring accommodating portion 31*d* has a shape that is recessed from the lower side to the upper side.

The positioning portion 31*e* is formed in the insertion hole 31*b*. The positioning portion 31*e* positions the movable contact piece 8 in the longitudinal direction of the movable contact piece 8. The positioning portion 31*e* has a shape that is recessed toward the rear in the rear surface of the insertion hole 31*b*. The positioning portion 31*e* engages with one of the pair of engaging portions 8*d* of the movable contact piece 8.

The sliding portion 31*f* has a shape that follows the shape of the guide portion 26, and is guided by the guide portion 26. The sliding portion 31*f* slides in the up-down direction with respect to the guide portion 26.

The second member 32 is a body separate from the first member 31. The second member 32 is assembled to the first member 31 from the side opposite to the side where the electromagnet block 4 is located. The second member 32 is attached so as to cover the insertion hole 31*b* of the first member 31 from the front, and prevents the movable contact piece 8 and the contact spring 10 from slipping out of the insertion hole 31*b*. The movable contact piece 8 is sandwiched by the first member 31 and the second member 32 from the front-rear direction. That is, the movable contact piece 8 is restricted from moving in the lateral direction by the first member 31 and the second member 32.

Figure 1:
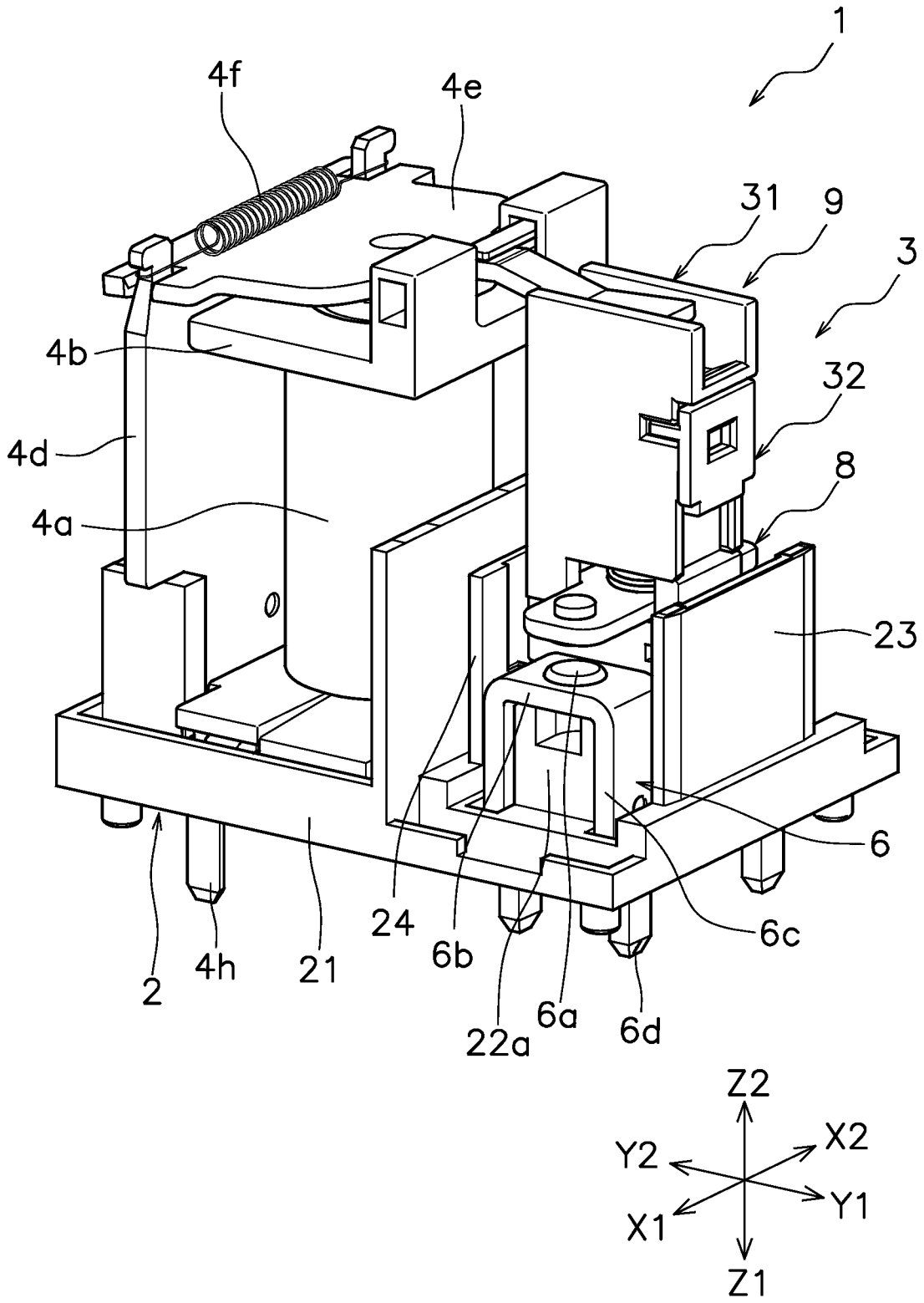
FIG. 1 is a perspective view of an electromagnetic relay.
Figure 2:
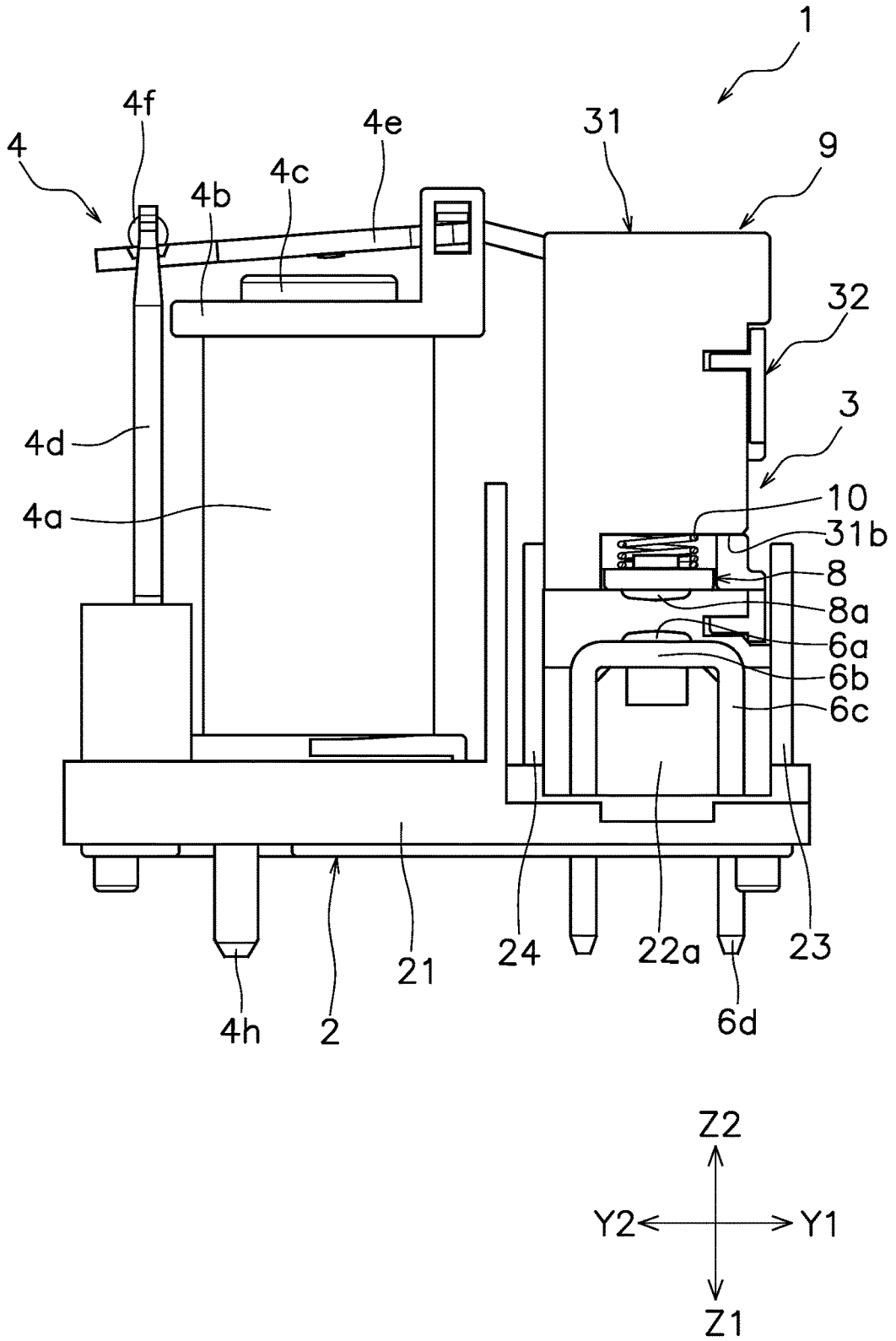
FIG. 2 is a side view of the electromagnetic relay.
Figure 3:
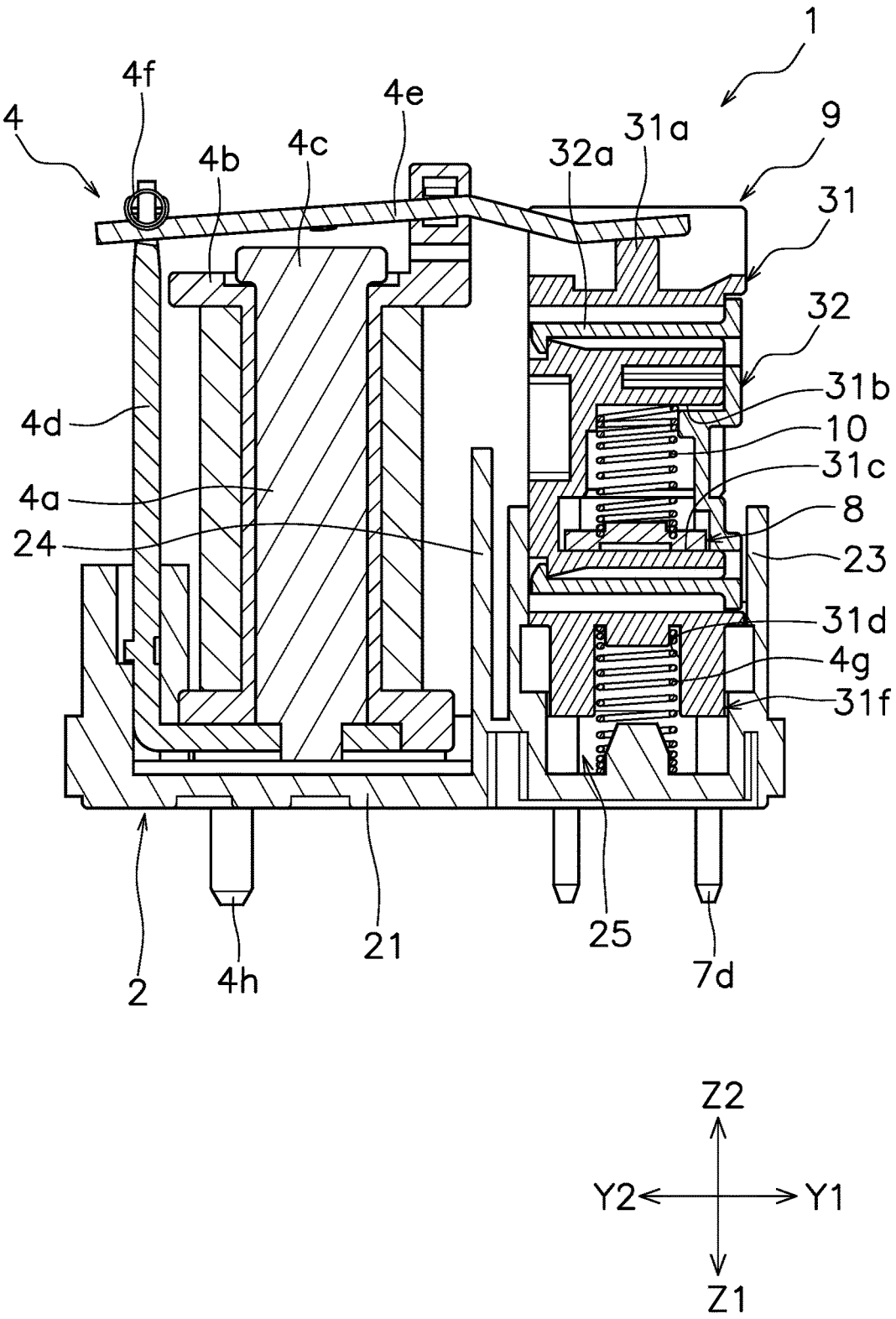
FIG. 3 is a cross-sectional view of the electromagnetic relay cut along a plane orthogonal to the left-right direction.

The second member 32 is coupled to the first member 31 by a snap fit. The second member 32 includes a pair of claw portions 32*a*. As shown in FIG. 3, the pair of claw portions 32*a* penetrate the first member 31 in the front-rear direction and engage with a locking portion that is located at the rear surface of the first member 31.

The second member 32 further includes a positioning portion 32*b* for positioning the movable contact piece 8 in the longitudinal direction of the movable contact piece 8. The positioning portion 32*b* engages with the other of the pair of engaging portions 8*d* of the movable contact piece 8.

The second member 32 is at a position separated from the base 2 and the electromagnet block 4. That is, the second member 32 is not in direct contact with the base 2 and the electromagnet block 4, and does not slide with respect to the base 2. The second member 32 moves integrally with the first member 31.

The contact spring 10 is a coil spring and is disposed above the movable contact piece 8. The contact spring 10 biases the movable contact piece 8 in the contact direction (downward in the present embodiment). The contact spring 10 is housed in the insertion hole 31*b* of the first member 31 in a state of being compressed in the up-down direction. The contact spring 10 presses the movable contact piece 8 toward the support portion 31*c* of the first member 31. The contact spring 10 is disposed in contact with the first member 31 and the movable contact piece 8. The outer peripheral surface of the upper end of the contact spring 10 is in contact with the inner surface of the insertion hole 31*b* and the inner surface of the second member 32, whereby radial movement of the contact spring 10 is restricted. The upper end of the contact spring 10 comes into contact with the inner surface of the insertion hole 31*b*. The lower end of the contact spring 10 is disposed on the spring support portion 8*c* of the movable contact piece 8, whereby radial movement of the contact spring 10 is restricted.

The electromagnet block 4 is disposed to the rear of the contact device 3. The electromagnet block 4 moves the movable contact piece 8 in the up-down direction via the movable member 9. The electromagnet block 4 includes a coil 4*a*, a spool 4*b*, a fixed iron core 4*c*, a yoke 4*d*, a movable iron piece 4*e*, a hinge spring 4*f*, and a return spring 4*g*.

The coil 4*a* is wound around the outer circumference of the spool 4*b*. The coil 4*a* is connected to the coil terminal 4*h*. The coil terminal 4*h* includes a pair of tab terminals and protrudes downward from the bottom portion 21 of the base 2. The coil terminal 4*h* is connected to an external power source that supplies drive power to the coil 4*a*. The spool 4*b* extends in the up-down direction. The fixed iron core 4*c* is disposed in the inner peripheral portion of the spool 4*b*. The yoke 4*d* is disposed so as to cover the rear of the coil 4*a*. The yoke 4*d* is substantially L-shaped when viewed from the left-right direction. The yoke 4*d* is connected to the lower end of the fixed iron core 4*c*.

The movable iron piece 4*e* is rotatably supported at the yoke 4*d* via the hinge spring 4*f*. The movable iron piece 4*e* rotates with the upper end of the yoke 4*d* as a fulcrum. The movable iron piece 4*e* is disposed above the fixed iron core 4*c*. The movable iron piece 4*e* is disposed so that the front end thereof is in contact with the press portion 31*a* of the first member 31. The movable iron piece 4*e* presses the press portion 31*a* of the first member 31 downward in accordance with the rotation. The hinge spring 4*f* biases the movable iron piece 4*e* in a direction away from the fixed iron core 4*c*. The return spring 4*g* is disposed between the first member 31 of the movable member 9 and the bottom portion 21 of the base 2. The return spring 4*g* is disposed in contact with the first member 31. The upper part of the return spring 4*g* is accommodated in the spring accommodating portion 31*d*, while the lower part is accommodated in the recess 25. The return spring 4*g* biases the movable member 9 in the opening direction (upward in the present embodiment).

Next, the operation of the electromagnetic relay 1 will be described. In the open state in which no voltage is applied to the coil 4*a*, the movable member 9 is pressed in the opening direction by the elastic force of the hinge spring 4*f* and the return spring 4*g*. Therefore, the first movable contact 8*a* is separated from the first fixed contact 6*a*, and the second movable contact 8*b* is separated from the second fixed contact 7*a*.

When a voltage is applied to the coil 4*a* whereby the electromagnet block 4 is excited, the movable iron piece 4*e* is attracted to the fixed iron core 4*c* and rotates, and the movable member 9 is pressed in the contact direction by the movable iron piece 4*e*. As a result, the movable member 9 moves in the contact direction against the elastic forces of the hinge spring 4*f* and the return spring 4*g*. As the movable member 9 moves in the contact direction, the contact spring 10 moves in the contact direction. As a result, the movable contact piece 8 moves in the contact direction, such that the first movable contact 8*a* comes into contact with the first fixed contact 6*a*, and the second movable contact 8*b* comes into contact with the second fixed contact 7*a*. When the application of the voltage to the coil 4*a* is stopped, the movable member 9 moves in the opening direction by the elastic force of the hinge spring 4*f* and the return spring 4*g*.

In this electromagnetic relay, since the movable contact piece 8 and the contact spring 10 are inserted into the movable member 9 from the side opposite the side on which the electromagnet block 4 is located, an improvement in ease of assemble can be achieved. Moreover, since the movable member 9 moves according to the rotation of the movable iron piece 4*e*, the movable contact piece 8 and the contact spring 10 can be supported by the first member 31 constituted by a single member in the moving direction of the movable member 9. As a result, the position accuracy of the movable contact piece 8 in the moving direction of the movable member 9 can be improved. Since the first member 31 includes the press portion 31*a* to be pressed by the movable iron piece 4*e* and the support portion 31*c* for supporting the movable contact piece 8 in the moving direction of the movable member 9, it is possible to further improve the positional accuracy of the movable contact piece 8 in the moving direction of the movable member 9, as compared to the case of the press portion 31*a* and the support portion 31*c* being constituted by separate members.

In the movable member 9 of the present embodiment, only the first member 31 comes into contact with the base 2.

As a result, since the positional accuracy between the movable member 9 and the base 2 can be improved, tilting and wear of the movable member 9 can be decreased.

Since the contact spring 10 is disposed in contact with the first member 31 of the movable member 9 and the movable contact piece 8 in the moving direction of the movable member 9, the positional accuracy of the movable contact piece 8 in the moving direction of the movable member 9 can be improved.

While preferred embodiments of the electromagnetic relay according to one aspect of the present invention have been described above, it should be understood that the present invention is not limited to the above embodiment, and various changes can be made without departing from the gist of the invention. For example, the configuration of the contact device 3 or the electromagnet block 4 may be changed.

The first member 31 should include at least the press portion 31*a* and the support portion 31*c*. For example, the spring accommodating portion 31*d* may be omitted in the first member 31.

The second member 32 may be omitted. In this case, for example, the insertion hole 31*b* of the first member 31 may have a shape that prevents the movable contact piece 8 and the contact spring 10 from slipping out of the insertion hole 31*b*.

REFERENCE NUMERALS

1 Electromagnetic relay
2 Base
4 Electromagnet block
4*e* Movable iron piece
6 First fixed terminal
6*a* First fixed contact
7 Second fixed terminal
7*a* Second fixed contact
8 Movable contact piece
8*a* First fixed contact
8*b* Second fixed contact
9 Movable member
10 Contact spring
31 First member
31*a* Press portion
31*b* Insertion hole
31*c* Support portion
32 Second member

The invention claimed is:

1. An electromagnetic relay comprising:

a first fixed terminal including a first fixed contact;

a second fixed terminal including a second fixed contact;

a movable contact piece including a first movable contact facing the first fixed contact and a second movable contact facing the second fixed contact;

a movable member configured to move in a moving direction including a first direction extending from the first movable contact toward the first fixed contact and a second direction extending from the first fixed contact toward the first movable contact, the movable member further configured to support the movable contact piece;

a contact spring disposed in the movable member, the contact spring biasing the movable contact piece in the first direction; and an electromagnet block configured to move the movable member in the moving direction of the movable member, the electromagnet block including a movable iron piece which is rotatable, the movable member including a first member constituted by a single member, the first member including a press portion to be pressed in the first direction by the movable iron piece in accordance with rotation of the movable iron piece, and a support portion configured to support the movable contact piece in the moving direction of the movable member, the first member having an insertion hole opening toward a first side opposite to a second side where the electromagnet block is located, the insertion hole configured to receive the movable contact piece and the contact spring.

2. The electromagnetic relay according to claim 1, wherein the contact spring is disposed in contact with the first member of the movable member and the movable contact piece in the moving direction of the movable member.

3. An electromagnetic relay comprising:

a first fixed terminal including a first fixed contact;

a second fixed terminal including a second fixed contact;

a movable contact piece including a first movable contact facing the first fixed contact and a second movable contact facing the second fixed contact;

a movable member configured to move in a moving direction including a first direction extending from the first movable contact toward the first fixed contact and a second direction extending from the first fixed contact toward the first movable contact, the movable member further configured to support the movable contact piece;

a contact spring disposed in the movable member, the contact spring biasing the movable contact piece in the first direction;

an electromagnet block configured to move the movable member in the moving direction of the movable member, the electromagnet block including a movable iron piece which is rotatable, and a return spring disposed in contact with the first member of the movable member, the return spring biasing the first member of the movable member in the second direction, the movable member including a first member constituted by a single member, the first member including a press portion to be pressed in the first direction by the movable iron piece in accordance with rotation of the movable iron piece, and a support portion configured to support the movable contact piece in the moving direction of the movable member.

4. The electromagnetic relay according to claim 1, further comprising a base disposed in contact with only the first member with respect to the movable member, the base configured to guide movement of the movable member.

5. The electromagnetic relay according to claim 4, wherein the base restricts the movement of the movable member in a longitudinal direction and a lateral direction of the movable contact piece.

6. The electromagnetic relay according to claim 1, wherein the movable member further includes a second member which is a separate body from the first member, and the second member is assembled to the first member from the first side, the second member configured to prevent the movable contact piece and the contact spring from slipping out of the insertion hole.

7. The electromagnetic relay according to claim 6, wherein the second member includes a positioning portion configured to position the movable contact piece in a longitudinal direction of the movable contact piece, and the movable contact piece further includes a first engaging portion engaging with the positioning portion of the second member.

8. The electromagnetic relay according claim 1, wherein the first member includes a positioning portion configured to position the movable contact piece in a longitudinal direction of the movable contact piece, and the movable contact piece further includes a second engaging portion engaging with the positioning portion of the first member.

9. The electromagnetic relay according to claim 6, wherein the movable contact piece is restricted from moving in a lateral direction of the movable contact piece by the first member and the second member of the movable member.

10. The electromagnetic relay according to claim 1, wherein the movable contact piece further includes a spring support portion configured to position the contact spring.

11. The electromagnetic relay according to claim 1, wherein a return spring disposed in contact with the first member of the movable member, the return spring biasing the first member of the movable member in the second direction.

12. The electromagnetic relay according to claim 3, wherein the contact spring is disposed in contact with the first member of the movable member and the movable contact piece in the moving direction of the movable member.

13. The electromagnetic relay according to claim 3, further comprising a base disposed in contact with only the first member with respect to the movable member, the base configured to guide movement of the movable member.

14. The electromagnetic relay according to claim 13, wherein the base restricts the movement of the movable member in a longitudinal direction and a lateral direction of the movable contact piece.

15. The electromagnetic relay according to claim 3, wherein the second member includes a positioning portion configured to position the movable contact piece in a longitudinal direction of the movable contact piece, and the movable contact piece further includes a first engaging portion engaging with the positioning portion of the second member.

16. The electromagnetic relay according to claim 3, wherein the movable contact piece further includes a spring support portion configured to position the contact spring.

* * * * *